US005793277A

United States Patent [19]

Ichikawa et al.

[11] Patent Number: 5,793,277

[45] Date of Patent: Aug. 11, 1998

[54] PTC ELEMENT AND ITS MOUNTING MEMBER ASSEMBLY FOR ELECTRICAL JUNCTION BOX

[75] Inventors: Yuichiro Ichikawa; Hidenori Yamanashi, both of Shizuoka, Japan

[73] Assignee: Yazaki Corporation, Tokyo, Japan

[21] Appl. No.: 821,573

[22] Filed: Mar. 19, 1997

[30] Foreign Application Priority Data

Mar. 21, 1996 [JP] Japan ..... 8-064770

[51] Int. Cl.[6] ..... H01C 7/10

[52] U.S. Cl. ..... 338/22 R; 361/106; 219/505

[58] Field of Search ..... 338/22 R, 25, 338/7, 20, 59, 225 D; 361/822, 823, 826, 704, 715, 106; 174/52.1, 50, 59, 8, 37, 50.52; 219/504, 505; 439/366, 367, 144, 147

[56] References Cited

U.S. PATENT DOCUMENTS

| | | | |
|---|---|---|---|
| 2,754,472 | 7/1956 | Polye | 323/69 |
| 2,815,423 | 12/1957 | Polye | 201/63 |
| 4,272,471 | 6/1981 | Walker | 264/104 |
| 4,327,351 | 4/1982 | Walker | 338/22 |
| 4,445,026 | 4/1984 | Walker | 219/553 |
| 4,685,025 | 8/1987 | Carlomagno | 361/106 |
| 5,590,011 | 12/1996 | Hein | 361/106 |
| 5,645,746 | 7/1997 | Walsh | 219/505 |
| 5,682,130 | 10/1997 | Styrna | 337/190 |

FOREIGN PATENT DOCUMENTS

| | | |
|---|---|---|
| 61-234502 | 10/1986 | Japan . |
| 1-134350 | 9/1989 | Japan . |
| 2-41161 | 9/1990 | Japan . |

*Primary Examiner*—Michael L. Gellner
*Assistant Examiner*—Jeffrey Pwu
*Attorney, Agent, or Firm*—Armstrong, Westerman, Hattori, McLeland & Naughton

[57] ABSTRACT

A plurality of supporting columns extend downwardly from a top wall of a cover attached to the electrical junction box body. A case surrounding the PTC element has projecting bars extending in the cover attaching direction. Each of the supporting columns has a guide groove receives the associated projecting bar so as to hold the case. The PTC element joints to connecting terminal strips having a heat radiation face. Further, the connecting terminal strip has a saw-tooth face at each side end thereof.

4 Claims, 3 Drawing Sheets

PTC ELEMENT AND ITS MOUNTING MEMBER ASSEMBLY FOR ELECTRICAL JUNCTION BOX

BACKGROUND OF THE INVENTION

1. Field of the Invention

The present invention generally relates to a PTC (positive temperature coefficient) element and its mounting member assembly applied to an electrical junction box for electrical wiring in a motor vehicle to protect its electrical circuits.

2. Description of the Prior Art

Conventionally, in an electrical circuit in an electrical junction box applied for electrical wiring in a motor vehicle, there has been used a contact breaker or an electric fuse for protecting the circuit from an overcurrent.

Meanwhile, it has been known that a PTC element can be used for circuit protection from an overcurrent. However, there could have been the undermentioned drawbacks of the use of a PTC element in an electrical circuit in an electrical junction box because of heat generation by the PTC element.

That is, a circuit protection device provided with a PTC element against an overcurrent can interrupt the circuit by the increased resistance in the PTC element due to the heat generation in the PTC element by the current. Thence, a recovery of the protection circuit requires returning the PTC element to its usual temperature condition. To enhance heat radiation of a PTC element, Japanese Patent Laid-open No. 2-41161 has proposed a PTC element a having a conducting polymer element b with a corrugating portion c, as shown in FIG. 5.

However, the conducting polymer element b with the corrugating portion c gives little effect in heat radiation without a surrounding air flow, resulted in requiring a considerably long recovery time in the PTC element.

Moreover, Japanese Patent Application Laid-open No. 61-234502 discloses, as shown in FIG. 6, an application example of a PTC element d received in a protecting case e. However, the insufficient heat radiation from the covered space requires much recovery time for the PTC element d because of cooling only by itself, which is a drawback in the example.

Generally, an electrical junction box has a capped cover to prevent falling-out of electrical parts. For example, Japanese Utility Model Application Laid-open No. 1-134350, as shown in FIG. 7, discloses an electrical junction box having a cover f, a projection g formed on the cover f abutting against the top of an electric fuse h to prevent falling-out of the fuse. However, the projection g gives no heat radiation effect. Thence, a PTC element accompanying heat generation and received in an electrical junction box requires much recovery time of the PTC element due to the insufficient heat radiation. Further, this causes a heat expansion and deformation in the cover of the junction box, which could bring about such a problem as a failure in a circuit therein.

SUMMARY OF THE INVENTION

In view of the above-mentioned drawbacks, the present invention aims to improve the cover structure of the electrical junction boxes to enable a smooth heat radiation of the PTC element, which can reduce the recovery time of a protection circuit including the PTC element. The invention also provides a PTC element assembly with its mounting members for an electrical junction box to enable the easy mounting and dismounting, which giving a more efficient maintenance work of the assembly.

For achieving the object, a PTC element and its mounting member assembly for an electrical junction box according to this invention includes:

- a plurality of supporting columns extending downwardly from a top wall of a cover attached to the electrical junction box body,
- a case surrounding the PTC element and having a projecting bar extending in the cover mating direction, and
- a guide groove formed in the supporting column and receiving the projecting bar so as to hold the case.

Preferably, the case surrounding the PTC element can be attached to a housing jointed to an opposing connector provided in the junction box body;

- the assembly further comprises a pair of connecting terminal strips each having a connecting piece at one end thereof and a male electrical contacting portion at the other end,
- the terminal strips being able to be inserted into the connector housing,
- the connecting pieces being connected to a pair of electric pole plates of the PTC element and received in the case,
- the electrical contacting portions being able to connect to relative terminal fittings in the opposing connector.

Advantageously, the housing has a supporting base and a pair of terminal slots formed in the supporting base and inserting the connecting terminal strips, the housing supporting portion having an outer periphery formed with a projecting portion that engages with the case.

Moreover, each of the connecting terminal strips has effectively a heat radiation face between the connecting piece and the electrical contacting portion, the connecting terminal strip further having a saw-tooth face at each side end thereof.

DETAILED DESCRIPTION OF THE PREFERRED EMBODIMENTS

An embodiment of the invention will be discussed hereinafter.

Figure 1:
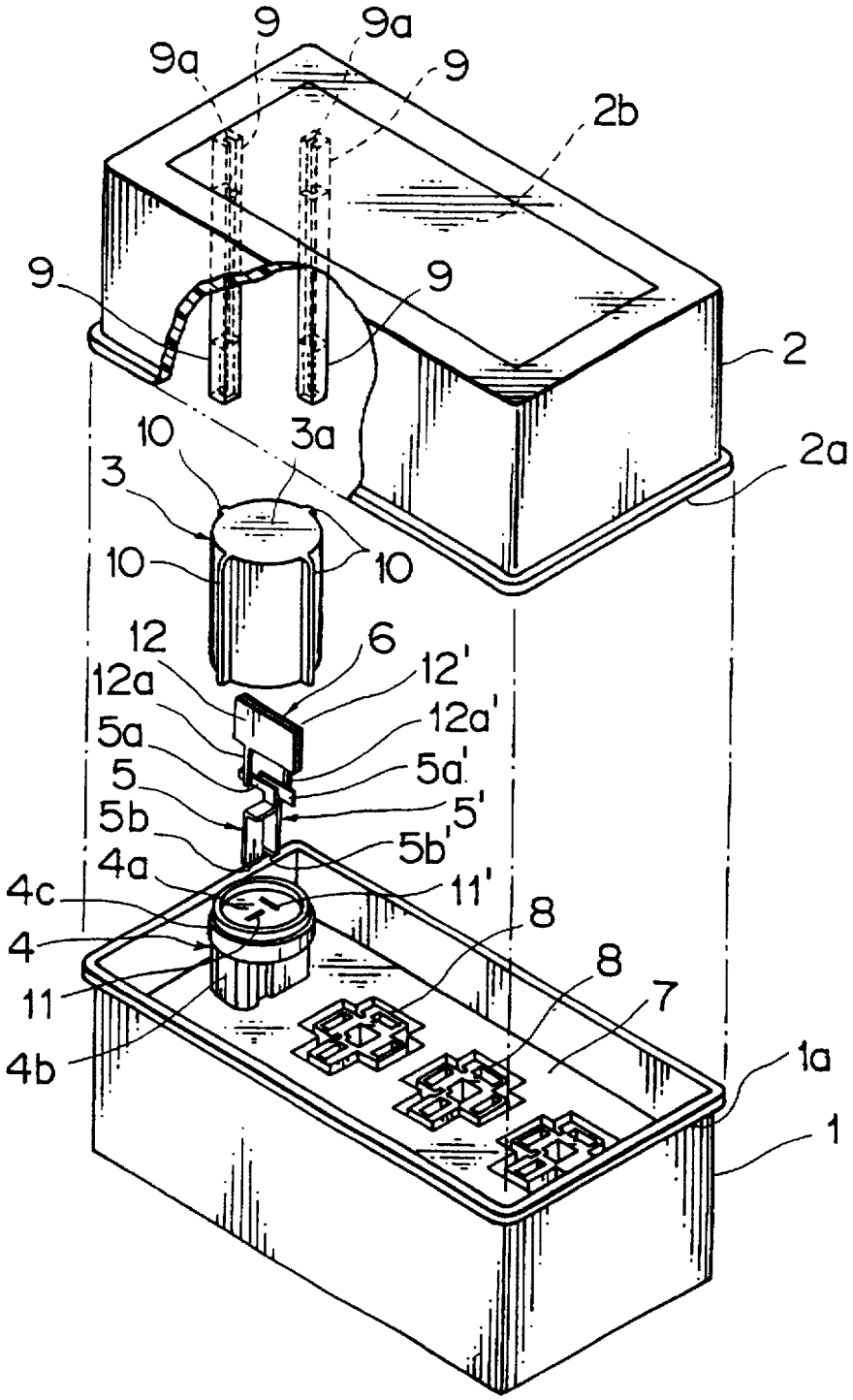
FIG. 1 is an exploded perspective view of an embodiment of a PTC element and its mounting member assembly for an electrical junction box according to the invention.

FIG. 1 shows an exploded perspective view of a PTC element and its mounting member assembly, which is an embodiment of the invention, for an electrical junction box.

In FIG. 1, denoted 1 is an electrical junction box body; 2 is a cover attached to the box body 1; and 3 is a protective case engaging with a housing 4 and receiving a PTC element 6. The element 6 connects to connecting terminal strips 5, 5'.

The junction box body 1 includes a wiring board 7 mounted with an opposing connector 8 which electrically connects to the terminal strips 5, 5' in the housing 4.

Figure 2:
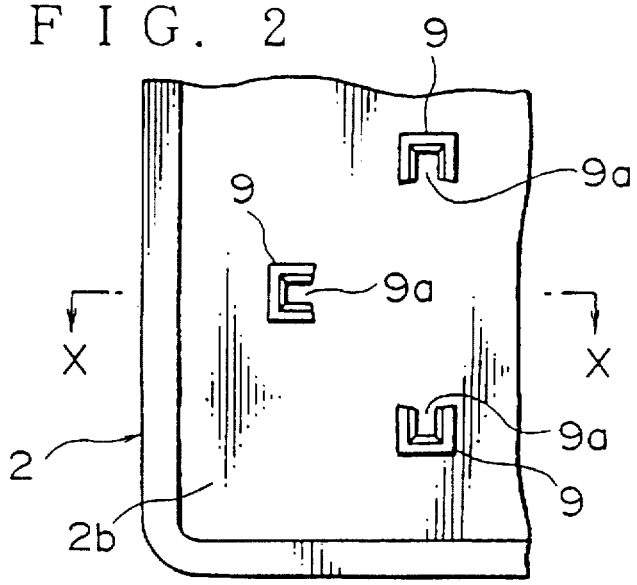
FIG. 2 is a top view showing major parts in a top wall of a cover shown in FIG. 1.
Figure 3:
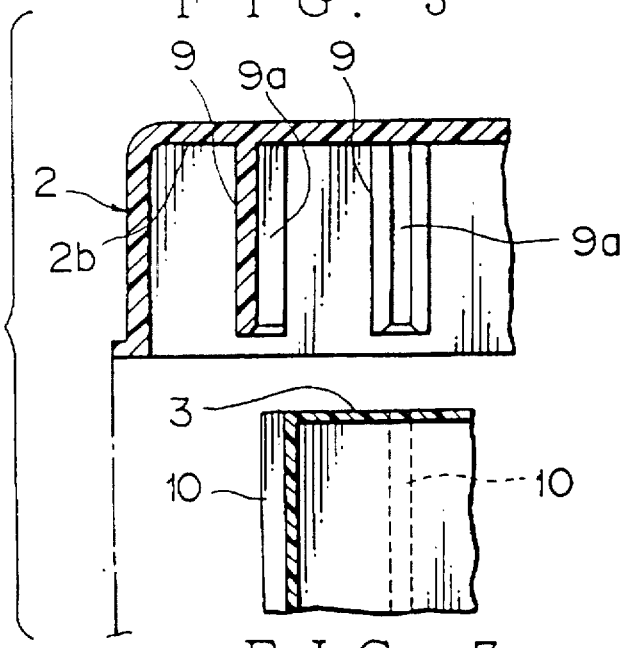
FIG. 3 is a sectional view taken on X—X in FIG. 2.
Figure 6:
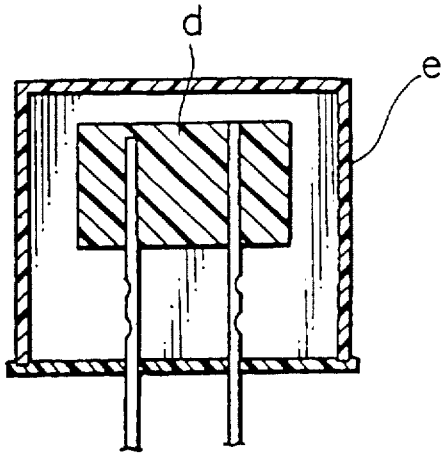
FIG. 6 PRIOR ART
FIG. 6 is a sectional view showing another previously known PTC element having been enclosed in a case.
Figure 7:
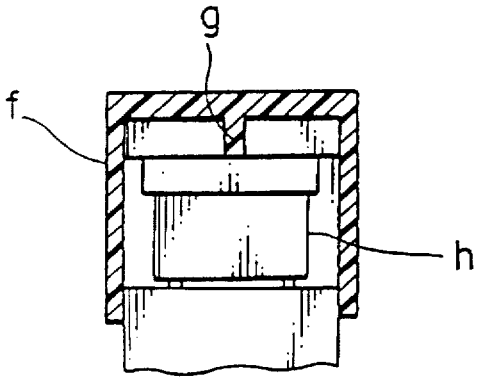
FIG. 7 PRIOR ART
FIG. 7 is a sectional view showing a previously known structure of a cover for an electrical junction box.

The cover 2 shapes like a box molded of a synthetic resin having a comparatively better thermal conductivity, of which an opening periphery 2*a* is secured to an aligned opposing periphery 1*a* of the junction box body 1 by lock fittings (not shown). On a top wall 2*b* of the cover 2, as shown in FIGS. 2 and 3, there are four supporting columns 9 extending in the attaching direction of the cover 2, each having a guide groove 9*a*.

The case 3 cylindrically formed of a thin metal sheet receives the PTC element 6 therein for protection. The case 3 has an outer peripheral wall 3*a* with a projecting bars 10 corresponding to the guide grooves 9*a* formed in the supporting columns 9 downwardly extending from the cover 2.

The housing 4 composes a connector supporting the PTC element 6 and jointing to the opposing connector 8. The housing 4 molded of a synthetic resin includes a circular supporting portion 4*a* and a female engagement surface 4*b*.

The supporting portion 4*a* of the housing 4 has terminal insertion holes 11, 11' for inserting and securing the connecting terminal strips 5, 5'. The supporting portion 4*a* has a circular periphery formed with a circumferential projecting portion 4*c* to receive the case 3.

The connecting terminal strips 5, 5' each formed by bending and cutting an electrically conductive metal plate, which have a connecting piece 5*a* or 5*a'* for the PTC element 6 at one end and a male electrical contacting portion 5*b* or 5*b'* at the other end.

The PTC element 6 includes a couple of electric pole plates 12, 12' and an electrically conducting polymer composition sandwiched between the couple of the plates, which gives a PTC effect. The electric pole plate 12, 12' connects each to the connecting piece 5*a* or 5*a'* of the connecting terminal strips 5, 5' by way of a lead piece 12*a* or 12*a'*. Thence, the PTC element 6 is supported by the connecting terminal strip 5, 5' engaged to the relative connector.

The connecting terminal strips 5, 5' are secured to the supporting portion 4*a* by forcibly inserting the electrical contacting portions 5*b*, 5*b'* through the terminal insertion holes 11, 11' to extend from the supporting portion 4*a* of the housing 4 to a connecting portions 4*b*. After the housing 4 has received the connecting terminal strips 5, 5', the projecting portion 4*c* engages with the case 3 so that the PTC element 6 is enclosed by the case 3.

The housing 4 having secured the connecting terminal strips 5, 5' engages to the opposing connector 8. Thus, the housing 4 couples to the wiring board 7 so that the electrical contacting portions 5*b*, 5*b'* of the connecting terminal strips 5, 5' connect to female terminal fittings (not shown) in the opposing connector 8.

Further, the projecting bars 10 of the case 3 are inserted in the guide grooves 9*a* of the supporting column 9 on the cover 2. Then, pushing the cover 2 toward the junction box body 1 advances the projecting bars 10 in the guide groove 9*a* so that the cover 2 is attached on the junction box body 1.

In use, the case 3 has connected to the cover 2 with the projecting bars 10 engaged with the guide grooves 9*a* formed in the supporting columns 9. Thence, the case 3 is stably retained without a structural chattering even by a relative motor vehicle vibration. Further, the heat generated by the PTC element 6 in the case 3 transfer promptly to the projecting bar 10 of the case 3 and the supporting column 9 on the cover 2. This enhances radiation of the generated heat, resulted in reduction in recovery time of a protection circuit including the PTC element 6.

In addition, the better heat radiation eliminates an unusual temperature increase in the junction box body 1.

Figure 4:
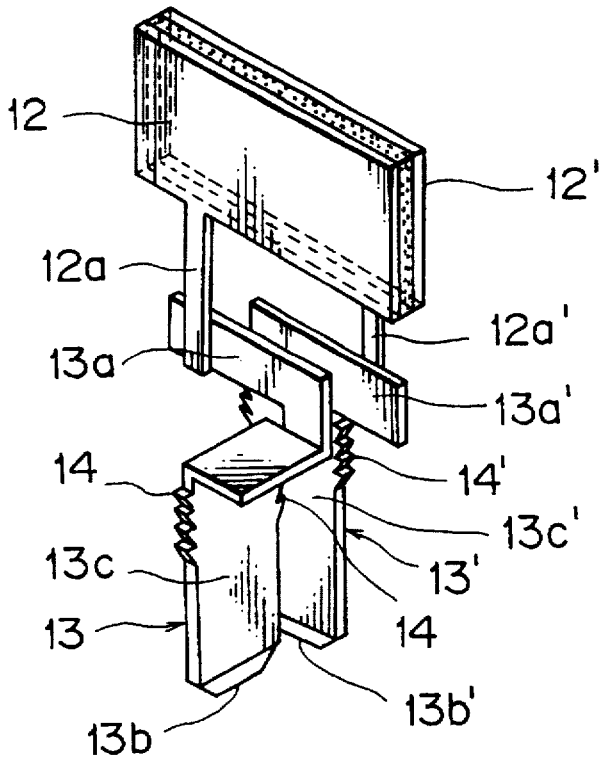
FIG. 4 is a perspective view showing connecting terminal strips in another embodiment of the invention.
Figure 5:
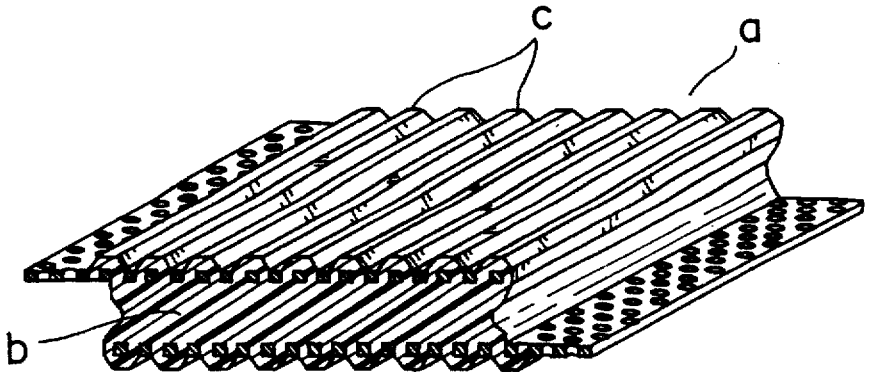
FIG. 5 PRIOR ART
FIG. 5 is a perspective view showing a previously known structure including a conducting polymer element, which composes a PTC element.

FIG. 4 is a perspective view of connecting terminal strips 13, 13' in another embodiment of the present invention, which have connected to the PTC element 6.

The connecting terminal strips 13, 13' have respectively a heat radiation face 13*c* or 13*c'* between a connecting piece 13*a* or 13*a'* and an electrical contacting portion 13*b* or 13*b'*. Further, each of the heat radiation faces 13*c*, 13*c'* has a saw-tooth face 14 or 14' at each side end thereof. The connecting pieces 13*a*, 13*a'* and the electrical contacting portions 13*b*, 13*b'*are similar in structure to the connecting pieces 5*a*, 5*a'* and the electrical contacting portions 5*b*, 5*b'* of the aforementioned connecting terminal strips 5, 5'. Hence, the heat radiation faces 13*c*, 13*c'* provided with the saw-tooth faces 14, 14' in the connecting terminal strips 13, 13', advantageously further enhances the heat radiation.

Next, operational effects of the invention will be discussed hereinafter.

In the present invention, the case enclosing the PTC element is secured to the supporting columns downwardly extending from the cover. Thence, the heat generated by the PTC element conducts from the case to the supporting columns to effectively radiate from the top wall of the cover. This eliminates deformation of the case due to thermal expansion and reduces recovery time of a protection circuit including the PTC element. In addition, the heat radiation faces with the saw-tooth faces in the connecting terminal strips further enhances the heat radiation effect. Moreover, the supporting columns of the cover secures the case so that falling-out of the case, even when the junction box receives vibration from a vehicle equipped with the box is certainly prevented. Besides, in capping the cover on the junction box body, the guide grooves of the supporting columns and the relative projecting bars of the case act as a positioning guide, which provides a better assembling process thereof. Thence, this invention improves the electrical junction box in its circuit performance and in assembling work thereof.

What is claimed is:

1. A PTC element and a mounting member assembly for said PTC element in combination for an electrical junction box comprising:

a cover having a top wall with inner and outer surfaces;

a plurality of supporting columns extending downwardly from said inner surface of said top wall of said cover attached to a body of said electrical junction box;

a case surrounding said PTC element and having projecting bars extending in a direction parallel to a direction in which said cover is attached;

a guide groove formed in each of said supporting columns and receiving each of said projecting bars so as to hold said case between said supporting columns;

a housing to which said case surrounding said PTC element can be attached;

an opposing connector, provided in said body of said electric junction box joined to said housing;

a pair of connecting terminal strips each having a connecting piece at a first end thereof and each of said connecting terminal strips being inserted into said housing, wherein said connecting pieces are connected to a pair of electric pole plates of said PTC element and are received in said case; and a male electrical contacting portion at a second end of each of said connecting terminal strips, wherein said male electrical contacting portion is able to connect to terminal fittings in said opposing connector.

2. The PTC element and a mounting member assembly for said PTC element in combination as claimed in claim 1, wherein said housing has a supporting portion and a pair of terminal slots formed in said supporting portion and inserting said connecting terminal strips, said supporting portion having an outer periphery formed with a projecting portion that engages said case.

3. The PTC element and a mounting member assembly for said PTC element in combination as claimed in claim 1, wherein each of said connecting terminal strips has a heat radiation face between said connecting piece and said electrical contacting portion.

4. The PTC element and a mounting member assembly for said PTC element in combination as claimed in claim 3, wherein said connecting terminal strip further has a saw-toothed face at each side end thereof.

* * * * *